US007249913B2

(12) United States Patent
Linville

(10) Patent No.: US 7,249,913 B2
(45) Date of Patent: Jul. 31, 2007

(54) ROLL UP ARTIFICIAL TURF

(75) Inventor: Stephen L. Linville, Destin, FL (US)

(73) Assignee: Coevin Licensing, LLC, Chatsworth, GA (US)

( * ) Notice: Subject to any disclaimer, the term of this patent is extended or adjusted under 35 U.S.C. 154(b) by 186 days.

(21) Appl. No.: 10/922,494

(22) Filed: Aug. 20, 2004

(65) Prior Publication Data

US 2006/0039754 A1 Feb. 23, 2006

(51) Int. Cl.
*E01C 13/08* (2006.01)

(52) U.S. Cl. ..... 404/73; 404/75

(58) Field of Classification Search ..... 404/19, 404/31, 32, 35, 72, 73, 75; 428/17, 87
See application file for complete search history.

(56) References Cited

U.S. PATENT DOCUMENTS 3,940,522 A * 2/1976 Wessells ..... 428/17
3,995,079 A 11/1976 Haas
4,044,179 A 8/1977 Haas
4,337,283 A 6/1982 Haas
4,389,435 A 6/1983 Haas
4,396,653 A 8/1983 Tomarin
4,637,942 A 1/1987 Tomarin
4,755,401 A * 7/1988 Friedrich et al. ..... 428/17
5,380,574 A 1/1995 Katoh et al.
5,460,867 A 10/1995 Magnuson et al.
5,958,527 A 9/1999 Prevost
5,962,101 A 10/1999 Irwin, Sr. et al.
6,048,282 A 4/2000 Prevost et al.
6,145,248 A 11/2000 Bergevin
6,299,959 B1 10/2001 Squires et al.
6,338,885 B1 1/2002 Prevost
6,491,991 B2 * 12/2002 Seaton ..... 428/17
6,620,482 B2 * 9/2003 Carr et al. ..... 428/87
6,794,007 B2 * 9/2004 Carr et al. ..... 428/87
6,800,339 B2 10/2004 Motz et al.

(Continued)

FOREIGN PATENT DOCUMENTS

EP 0062735 A2 10/1982

(Continued)

OTHER PUBLICATIONS

Justin Chadwick, Keeping Up With The Jones' Is Tough To Do, Press Release, Sportfield LLC, Mar. 17, 2003.

(Continued)

*Primary Examiner*—Gary S. Hartmann
(74) *Attorney, Agent, or Firm*—Wood, Herron & Evans, LLP

(57) ABSTRACT

A filled artificial turf includes a plurality of filled artificial turf sections which can be disconnected, rolled up and stored and then later unrolled and reconnected, thereby to enable a facility to accommodate a wide variety of sporting and non-sporting events, with no adverse effects on the playability of the turf. Each of the sections includes a backing, fibers secured to the backing, and a particulate fill with the fibers being of sufficient density and texture so as to substantially hold the particulate fill to the backing during rolling and unrolling. The sections also include hook and loop fasteners along the edges thereof, to facilitate simple and cost-effective connection and disconnection of the sections.

8 Claims, 5 Drawing Sheets

U.S. PATENT DOCUMENTS

| | | | | |
|---|---|---|---|---|
| 6,818,274 | B1 * | 11/2004 | Buck et al. | 428/87 |
| 2001/0033902 | A1 * | 10/2001 | Seaton | 428/15 |
| 2002/0028307 | A1 | 3/2002 | Prevost | |
| 2002/0136846 | A1 | 9/2002 | Prevost | |
| 2004/0058096 | A1 | 3/2004 | Prevost | |
| 2004/0234719 | A1 * | 11/2004 | Jones | 428/62 |

FOREIGN PATENT DOCUMENTS

| | | | |
|---|---|---|---|
| EP | 1375750 | A1 | 1/2004 |
| WO | WO 98/40559 | | 9/1998 |
| WO | WO 01/98589 | A2 | 12/2001 |
| WO | 02/076560 | * | 10/2002 |
| WO | WO 03/060236 | A1 | 7/2003 |

OTHER PUBLICATIONS

Form PCT/ISA/210 International Search Report for PCT/US2005/029665.

* cited by examiner

ROLL UP ARTIFICIAL TURF

FIELD OF THE INVENTION

This invention relates to artificial turf used for athletic fields. More specifically, this invention relates to a filled artificial turf with enhanced versatility, due to its roll up, unroll capability.

BACKGROUND OF THE INVENTION

In recent years, filled artificial turfs have substantially increased in popularity and use, compared to prior Astroturf-type artificial surfaces and natural grass athletic surfaces. Filled artificial surfaces look and feel more like natural grass, compared to prior Astroturf-type products. Also, compared to a natural grass field, a filled artificial turf has significantly lower maintenance costs, while allowing significantly more playing time.

For certain sporting facilities or venues, particularly indoor arenas or stadia, the facility may be used for a wide variety of events, including non-sporting events. Some of these events could have adverse effects on a typical filled artificial turf, due to excessive wear. These adverse effects become more acute as the number of these events increases. These adverse effects tend to reduce the playability of, and shorten the effective life of the artificial turf. Yet, these facilities need to accommodate non-sporting events to optimize the use and revenue generated by the facility. Thus, there is a need to accommodate the multi-purpose needs of such facilities, while at the same time minimizing or eliminating any adverse effects on the artificial turf used for sporting events.

U.S. patent application Ser. No. 10/104,030, published as U.S. Publication No. US 2002/0136846, in the name of Prevost, shows a Velcro-type, i.e. hook and loop, fastener arrangement for simplified installation of an artificial turf. The fastener arrangement extends along the bottoms of the edges of the field sections. This published U.S. application also shows removable turf sections located in various parts of the field, so that team logos or other insignia may be incorporated into the field. As the initial steps for creating a replaceable logo section, this publication discloses the removal of the infill from the designated logo, followed by cutting of the artificial turf around the perimeter of the logo section.

This publication does not address the need for a sporting facility to accommodate a wide variety of sporting and non-sporting events. Nor does this publication disclose the removal or reinstallation of an entire artificial turf surface as a way to meet that need.

Published U.S. application Ser. No. 10/453,525, published as U.S. Publication No. 2004/0058096 A1, also in the name of Prevost, is entitled, "Modular Synthetic Grass Turf Assembly" and discloses a plurality of tray-like artificial field units which are transportable. Each of the field units is, in effect, a mini filled artificial turf. The publication discloses disengageable edge borders on the turf units to help retain the particulate fill during transport. This publication discloses transportation of the units via a forklift, wherein the units remain in horizontal position and are supported on a flat sheet, so as not to deform during shipment or storage. This publication discloses that the tray like turf units have maximum dimensions of 15 feet by 48 feet. Thus, it would necessarily follow that about 80 of such turf units would be needed to cover just the actual playing surface of a typical U.S. football field, which has dimensions of 360 feet by 160 feet. Thus, removing and installing a field of this type would involve significant labor, time and equipment usage.

It is an object of this invention to improve upon the ability of a large facility to readily accommodate both sporting and non-sporting events, without adversely effecting the performance or durability of an artificial turf used in the same facility for sporting events.

It is another object of this invention to simplify and reduce the costs of transforming an indoor stadium from an athletic field, to a non-athletic surface use, and then back to an athletic field.

It is still another object of this invention to reduce the hardware, costs and steps needed to remove and then later reinstall a filled artificial turf.

SUMMARY OF THE INVENTION

The present invention achieves these above-stated objects via a filled artificial turf field which may be removed by disconnecting and rolling up a plurality of filled artificial turf sections, and reinstalled by unrolling and reconnecting the filled artificial turf sections. The filled artificial turf sections are readily disconnected and reconnected by hook and loop-type fasteners located along the bottoms of the edge joints at the seams located between the adjacently located sections of filled artificial turf. The artificial turf sections are constructed with tufted twisted fibers which substantially contain a particulate infill material, during use and during rolling and unrolling. The fibers have sufficient face weight to entrap or hold substantially all of the particulate infill against the backing. Face weight depends on a combination of parameters, including the fibers composition, the number of fibers, the height of the fibers, the number of tufts per inch in each row of tufts and the spacing of the tufted rows, i.e. the tuft gauge. As is known in the industry, face weight is the weight of fiber per square yard of unfilled artificial turf. One artificial turf which has proved suitable for this invention is known in the industry as REALGRASS™, made by Sportfield, with a face weight of 44 ounces. Due primarily to the relatively high face weight of this product, only minimal particulate loss occurs during roll up and removal and roll out and reinstallation of these filled artificial turf sections.

The rolls of filled artificial turf sections may be stored at an easily accessible location, preferably within the facility itself. Transport of these rolls to and from the field location may be performed by a vehicle adapted to accommodate rolls of filed sections of substantial weight, and with typical dimensions of 15 feet by 160 feet.

With this invention, a large facility can be easily transformed from an athletic venue having an artificial turf to a different use, such as a trade show requiring a concrete floor, and then back, without adversely affecting the filled artificial turf. Also, due largely to the simple hook and loop connections along the seams, and the retention of the particulate fill to the backing, this removal and reinstallation process is relatively simple and cost-effective. It can be done in relatively few steps, in a short time, with almost no additional hardware needed.

According to a preferred embodiment of the invention, each of the filled artificial turf sections includes a horizontal backing of polyethylene fibers tufted to the backing to extend upwardly therefrom, and a resilient particulate fill material, such as cuboidal rubber surrounding the fibers and having a desired height relative to the height of the fibers.

During initial installation, a team of installers unrolls a plurality of sections of artificial turf in a desired configuration on top of a foundation, to form an athletic field. The installers connect adjacently located sections with underlying strips which reside along and below the seams between the adjacently located sections. More specifically, the installers pull up the edges of the two adjoining sections, locate the strip under the seam, and then use an adhesive to adhere the top surface of the strip to the bottom surfaces of the adjacently located sections along the edges. Additionally, each of the strips has, on a lower surface, or underside thereof, a first component of a hook and loop fastener. When the sections are in place, connected together via the underlying adhered strip, the downwardly directed first components reside in direct contact with the underlying surface, in most cases the foundation. The initial field installation these first components are not used for any fastening purpose.

Thereafter, the installers place a particulate fill material on the connected sections, typically by a commercial spreader. The installers spread the particulate to create a substantially uniform depth, typically with brooms, to facilitate settling of the fill within and around the upright fibers. These spreading, or top dressing, and brooming steps may be repeated until a desired uniform fill depth is achieved. The field is then ready to be used.

When the facility must be transformed to accommodate a non-sporting event, the field can be removed and stored, section by section. To do this, a team of laborers removes the particulate fill along the seams of the adjacently located sections. This removal occurs by hand, or possibly by vacuum if the particulate fill is entirely rubber. This step helps the crew find and get access to the underlying adhered strips, in order to cut the strips along the seams. This cutting step separates the field sections, so that they are now back to their original sizes. However, the field sections are now filled with particulate and they have downwardly directed first connectors extending along the bottoms of the edges. The crew then rolls up the filled field sections, one by one, and moves them to a storage site. Due to the entrapment of the particulate fill by the fibers, the fill particles remain substantially contained during the roll up step. In rolling up the sections, the crew typically uses a rigid, elongated tube. This helps with subsequent transport of the rolled up sections of filled artificial turf.

When it is time to reinstall the athletic field, the crew moves the rolled up sections of filled artificial turf back to the foundation, to their desired positions. The crew then unrolls the filled artificial turf sections into place, thereby locating the downwardly directed first connectors in direct contact with the underlying surface. Thus, these first connectors and the adhered strips are now part of the turf sections. Subsequently, for each seam, the crew uses a second underlying strip to removably secure the adjacently located sections. This second strip extends along the seam under the edges of the adjacently located sections. This second strip has a second component of a hook and loop fastener extending from an upper surface thereof.

More specifically, along the seam the adjacently located sections are pulled up to enable the second strip to be located along and below the seam. This places the upwardly directed second component directly below the edges of the adjacently located sections and the corresponding downwardly directed first components. When the edges of the adjacently located sections are then laid back flat, the first and second components of the fastener securely engage each other to removably connect the sections along the seam. The crew then refills particulate above the seams as needed, to create a playing field with a substantially uniform fill depth, at the desired fill height. Thereafter, removal and reinstallation may occur, as needed, by repeating these same steps.

If desired, a pad may be installed over the foundation, where the athletic field will be located, prior to unrolling the sections of artificial turf. The pad, preferably of uniformly thick material, provides an additional degree of resiliency for the artificial turf.

Also, the backing may be perforated, if desired. The perforations enhance water drainage, if the field is to be outdoors. Even if the facility is an indoor stadium or arena, perforations may be desired. Although such perforations will not be used when the artificial turf is used indoors, the in-place perforations allow the artificial turf field to be later reinstalled and used at an outdoor facility, as an outdoor field. So the perforations provide built-in versatility for the artificial turf.

The objects and features of the present invention will become more readily apparent from the following detailed description and the accompanying drawings.

DETAILED DESCRIPTION OF THE PREFERRED EMBODIMENT OF THE INVENTION

Applicant's company has practiced this invention at the Alamodome in San Antonio, Tex., with a REALGRASS™ artificial turf. That has now been removed, stored and then reinstalled on several occassions. The invention has been successful, despite the skepticism expressed by others skilled in the art.

Figure 1:
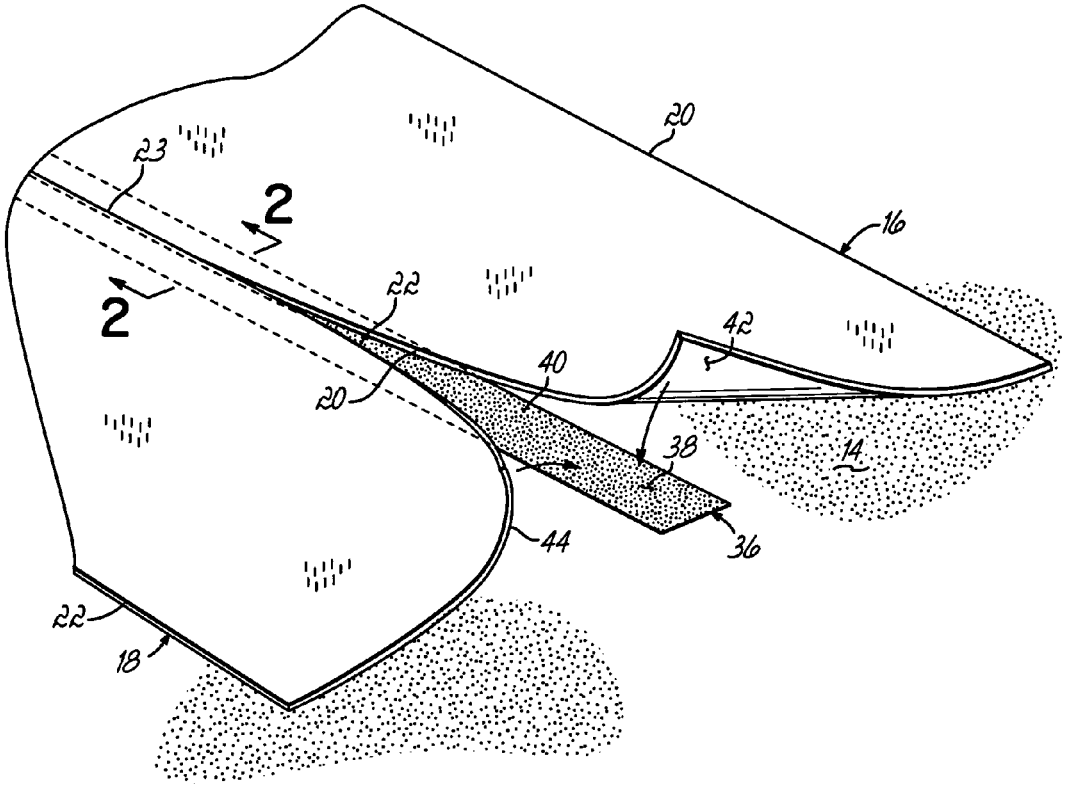
FIG. 1 is a perspective view which shows one aspect of initially connecting adjacently located sections of artificial turf, in accordance with a preferred embodiment of the invention.

FIG. 1 shows a rectangularly shaped first section 16 of artificial turf 16 residing next to a rectangularly shaped second section 18 of artificial turf 18 on a foundation 14. Applicant notes that the shape of the sections of artificial turf may vary, depending on the field or the sport. Also, the word "artificial" as used in this specification but the term "synthetic" is equally suitable. The first section 16 has two opposed side edges 20, and similarly, the second section 18 has two opposed side edges 22. The first and second sections of artificial turf 16, 18 are located next to each other such that one of the side edges 20 of the first section 16 abuts one of the side edges 22 of the second section 18 along a seam 23. To get a straight seam 23, one or more of the sections 16, 18 may be cut after placement on the foundation 14, as is known in the industry.

After placement on the foundation 14, sections 16, 18 are pulled up along the seam 23 to place a first connecting strip 36 under the adjacently located first and second sections 16, 18 under the seam 23. The connecting strip 36 has an upper surface 38. Adhesive 40 applied to the upper surface 38 adheres the connecting strip 36 to the undersides 42, 44 of the first and second sections 16, 18 along the seam 23, as is known in the industry.

Figure 2:
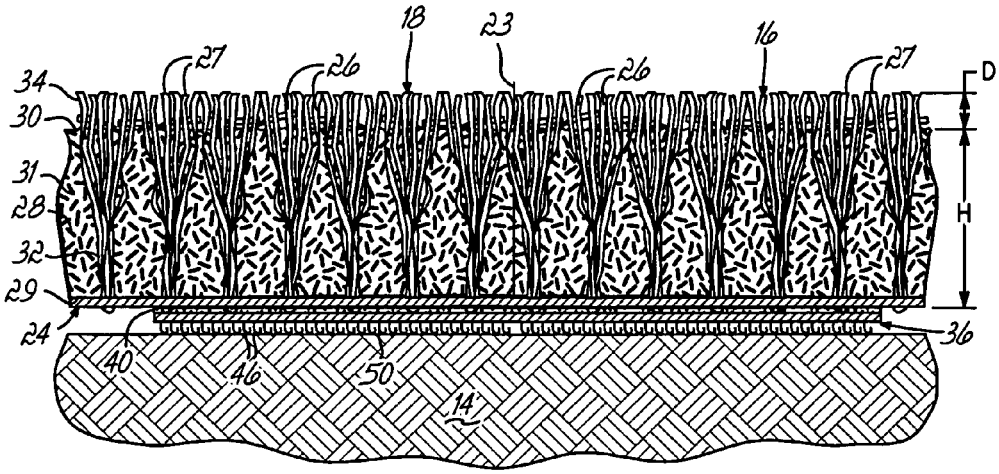
FIG. 2 is a cross-sectional view taken along lines 2-2 of FIG. 1.

FIG. 2 shows that connecting strip 36 has a first component 46 of a two component fastener, namely a hook and loop fastener 48 directed downwardly from a lower surface 50 thereof. The lower surface 50 of the connecting strip 36, and more particularly the first component 46 directly contacts the surface residing below, in this case the foundation 14. Alternatively, a pad could reside below surface 50 (or reference numeral 14 could be regarded as a pad located on top of a foundation). The connecting strip 36 may be nylon, with the first component 46 secured to the lower surface 50 by sewing or adhesive or any other securement structure which secures these components together so as to not pull apart.

After the adjacent first and second sections 16, 18 are connected along seam 23 and all of the sections of the field are similarly connected, particulate fill 28 is added to create a substantially uniform fill depth as shown in FIG. 2. This is typically done by top dressing with a spreader and then brooming and repeated as necessary, to achieve the desired fill depth. The brooming causes the particulate to move or settle downwardly, to surround and support upwardly directed fibers 28. The field 10 is now ready for use.

As shown in FIG. 2, the relationship between the particulate fill and the fibers 26, which extend upwardly from a backing 24, is such that the particulate is entrapped or contained during use of the field and thereafter during roll up. The backing 24 has three primaries, the first primary being a woven polypropylene, the second primary being a non-woven colbond, and the third primary being a woven lenoweave, known in the art as Actionback. A secondary of polyurethane is coated in liquid form onto the primaries of the backing 24, after the fibers 26 have been tufted. This tufting through two or more primaries is shown in applicant's U.S. Pat. No. 5,962,101, which is fully incorporated by reference herein in its entirety. This triple primary backing weighs 10.74 ounces per square yard. The secondary weighs 28 ounces per square yard. The backing has sufficient lateral structural integrity to withstand the rolling and unrolling of repeated installations.

The plurality of grass-like pile filaments, or fibers 26 are texturized prior to being tufted to the backing 24, to an extent that their overall height is reduced from a selected height of 2.25 inches to a final height of about 1.75 inches. This texturizing causes the fibers 26 to be kinked along their entire length. The fibers 26 are monofiliment mini tapes with six strands twisted together and one twist per inch. The strands have a width of about 2 millimeters and a thickness of about 100 microns. The fibers 26 are made of polyethylene. The yarn denier is 6/7500 Dtex or alternatively 6/8100 Dtex. The grass-like fibers 26 are tufted to the backing 24 using a tufting gauge of 0.5 inches, and 6-7 tufts per inch. The pile weight is 44 ounces per square yard. The weight of the triply primary backing is 10.74 ounces per square yard. The weight of the secondary is 28 ounces per square yard. Therefore, the total weight is 78.74 ounces per square yard. The upper ends 27 of the fibers 26 curl down to cover and trap or contain the particulate 28 of rubber granules, thereby preventing the rubber granules from spilling out during the rolling/unrolling process.

The particulate fill 28 extends upwardly from the backing 24 to a desired height H. As illustrated in FIG. 2, the particulate fill 28 has a top level designated by the reference numeral 30 and located a distance "D" below the upper ends 27 of the fibers 26. Thus, the fibers 26 have lower portions 32 located within the particulate fill 28 and upper portions 34 extending above the particulate fill 28. The upper portions 34 give the playing surface a green appearance and resemble natural grass. The particulate fill material 28 helps stabilize the pile filaments 26 in place and helps prevent the pile filaments 26 from becoming trampled or run-down with a fiber height of 1.75 inches, the preferred height for the particulate fill 28 is 1.375 inches, so that the distance D is 0.375 inches.

In the preferred embodiment, the particulate fill material 28 is cuboidal rubber. If desired, the particulate fill 28 may include two distinct layers as disclosed in applicant's co-pending patent application Ser. No. 10/634,217, which is fully incorporated by reference herein. The total weight of the filled turf is 78.74 ounces per square yard.

Figure 3:
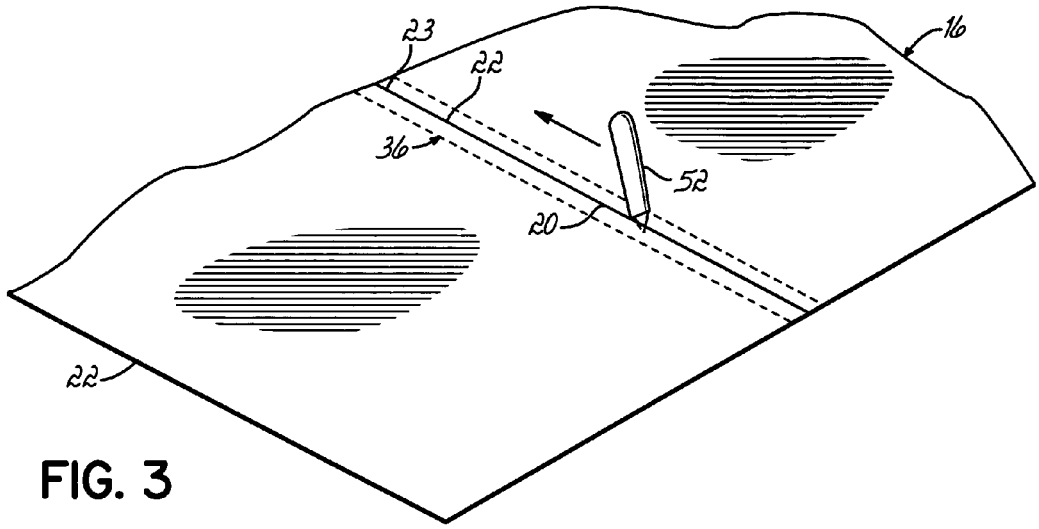
FIG. 3 is a perspective view, similar to FIG. 1, which shows one aspect of removing adjacently located sections, in accordance with the preferred embodiment of the invention.

After the field has been used and is ready for removal, particulate fill 28 is removed along the seam 23 of interconnected sections 16, 18. As shown in FIG. 3, the connecting strip 36 is cut along the seam 23 to separate the first and second sections 16, 18 with a cutting instrument 52.

Figure 4:
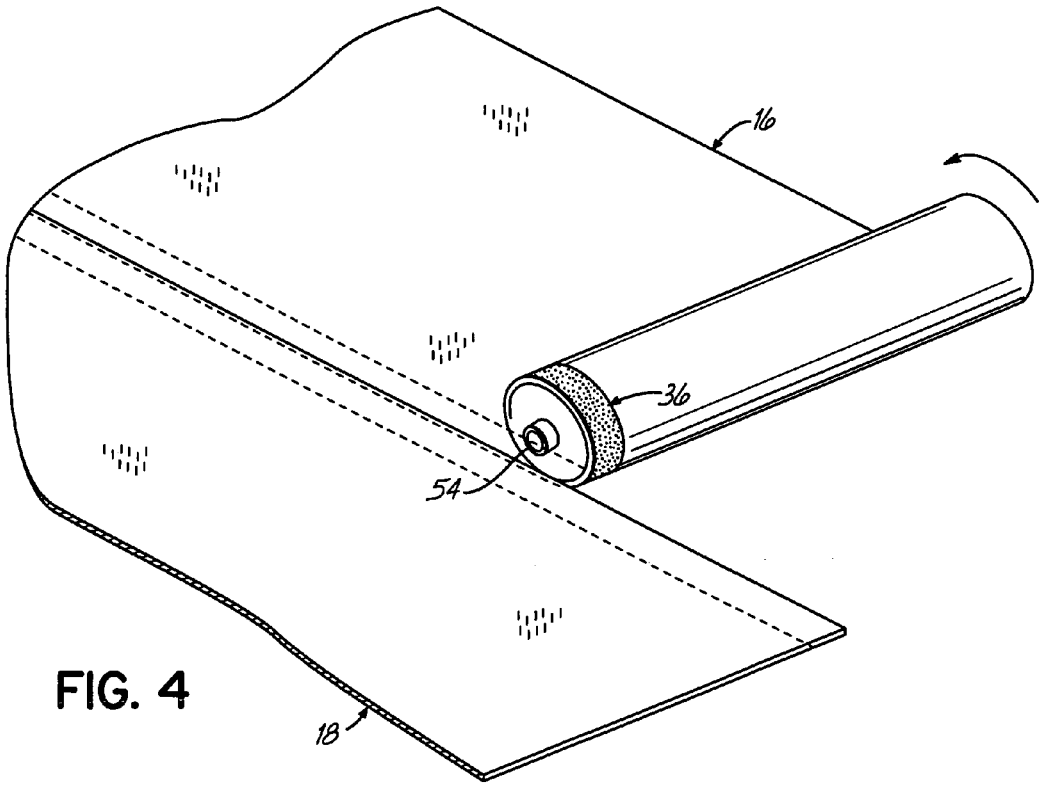
FIG. 4 is a perspective view, similar to FIGS. 1 and 3 which shows another aspect of removing adjacently located sections of filled artificial turf, in accordance with the preferred embodiment of the invention.

As shown in FIG. 4 after the connecting strip 36 has been cut, thereby separating the first and second sections 16, 18, the first section 16 is rolled up around a core 54, preferably an elongated hollow tube. If desired, the core 54 may be omitted and the section 16 of filled artificial turf may be rolled up around itself. As the first section of filled artificial turf 16 is being rolled up, a portion of the connecting strip 36 adhered thereto is rolled up as well. Each section 16, 18 is rolled up in this manner, and then moved to a storage site or location. This rolling process may be performed manually or be automatically.

Figure 5:
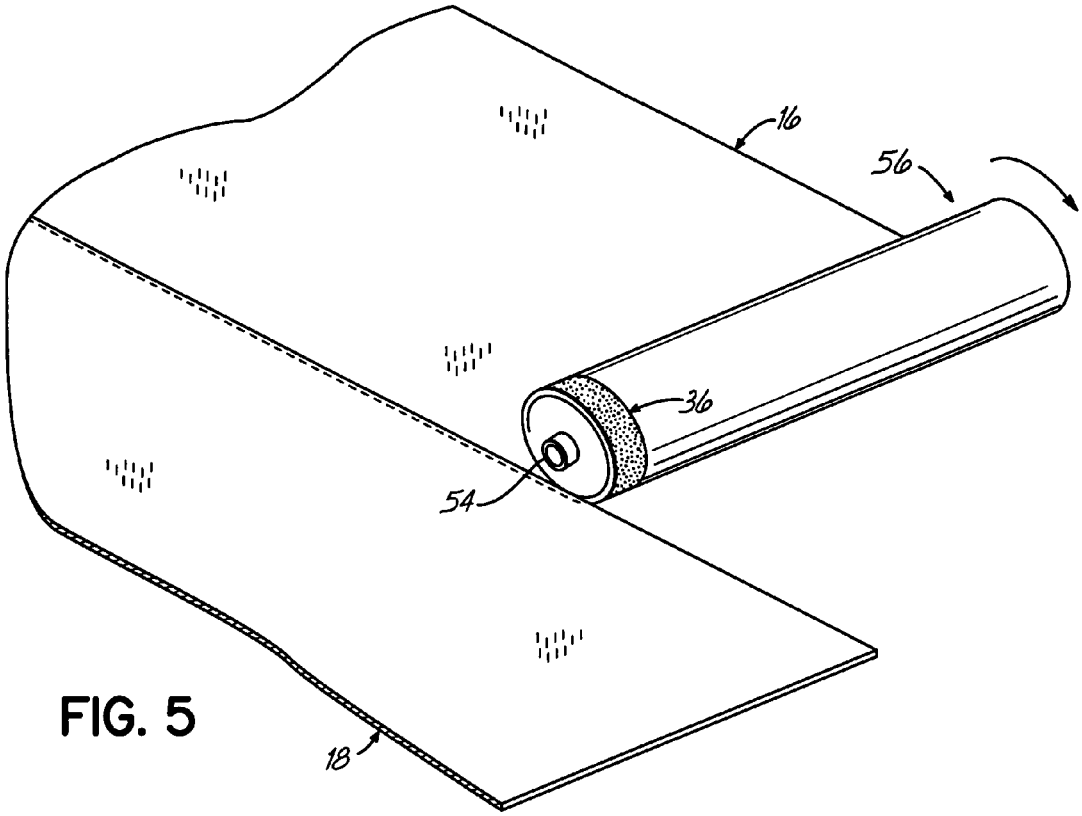
FIG. 5 is a perspective view, similar to FIGS. 1, 3, and 4, which shows one aspect of reinstalling adjacently located sections of filled artificial turf, in accordance with the preferred embodiment of the invention.

Referring to FIG. 5, when it is time to reinstall the field 10, the rolls 56 of sections of filled artificial turf are moved to their desired locations. The first and second sections of filled artificial turf 16, 18 are unrolled and adjusted so one of the side edges 20 of the first section 16 abuts one of the side edges 22 of the second section 18 along seam 23. Once the sections of filled artificial turf 16, 18 are unrolled and adjusted to their intended positions, the portions of the connecting strip 36 adhered to the sections 16, 18 having the first component 46 of the hook and loop fastener 48 on the underside thereof contact the foundation 14.

Figure 6:
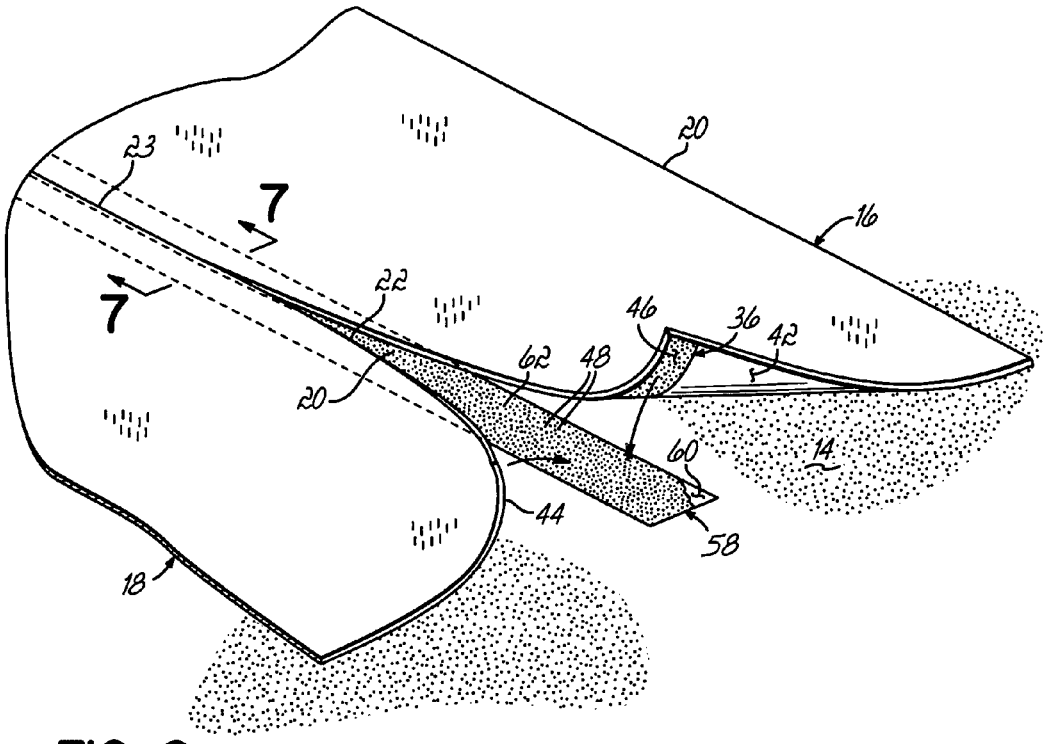
FIG. 6 is a perspective view, similar to FIGS. 1, 3, 4, and 5, which shows one aspect of reinstalling adjacently located sections of filled artificial turf, in accordance with the preferred embodiment of the invention.
Figure 7:
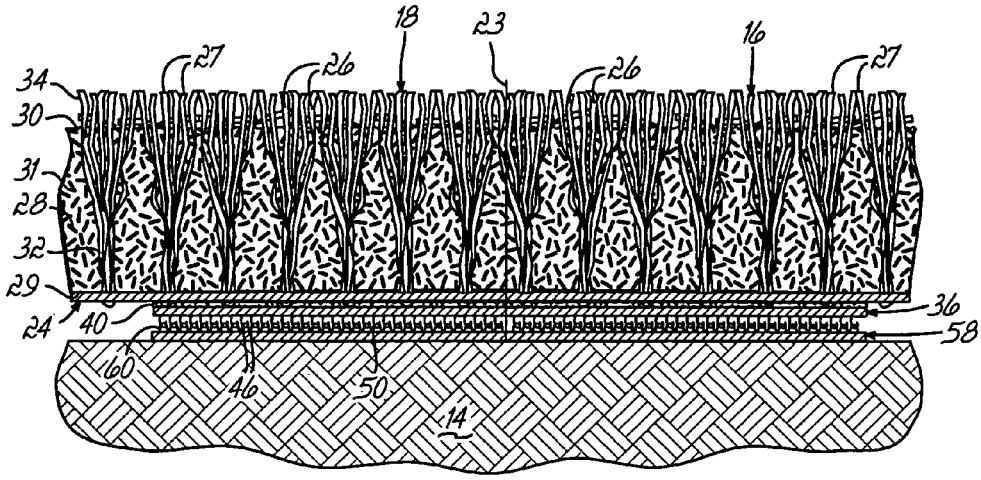
FIG. 7 is a cross-sectional view taken along lines 7-7 of FIG. 6.

As shown in FIGS. 6 and 7, the longitudinal side edges of the first and second sections of filled artificial turf 16, 18 adjacent to or proximate the seam 23 are pulled upwardly to expose the foundation 14. A second connecting strip 58 is then placed on the foundation 14 under the seam 23 between the first and second sections 16, 18 of filled artificial turf. The second connecting strip 58 has located on an upper surface 60 thereof a second component 62 of the hook and loop fastener 48. After the strip 58 is placed in its desired location, the first and second sections 16, 18 of filled artificial turf are lowered in the direction of arrows 64 so that the first and second components 46, 62 of the hook and loop fastener 48 removably engage each other, as is known in the art. In this manner, the first and second sections of filled artificial turf 16, 18 are removably joined together. Thereafter, particulate fill 28 is placed over the seam 23 to create a uniform field depth. Any number of sections or segments of filled artificial turf may be easily joined together in this manner to create a removable athletic playing surface.

Figure 8:
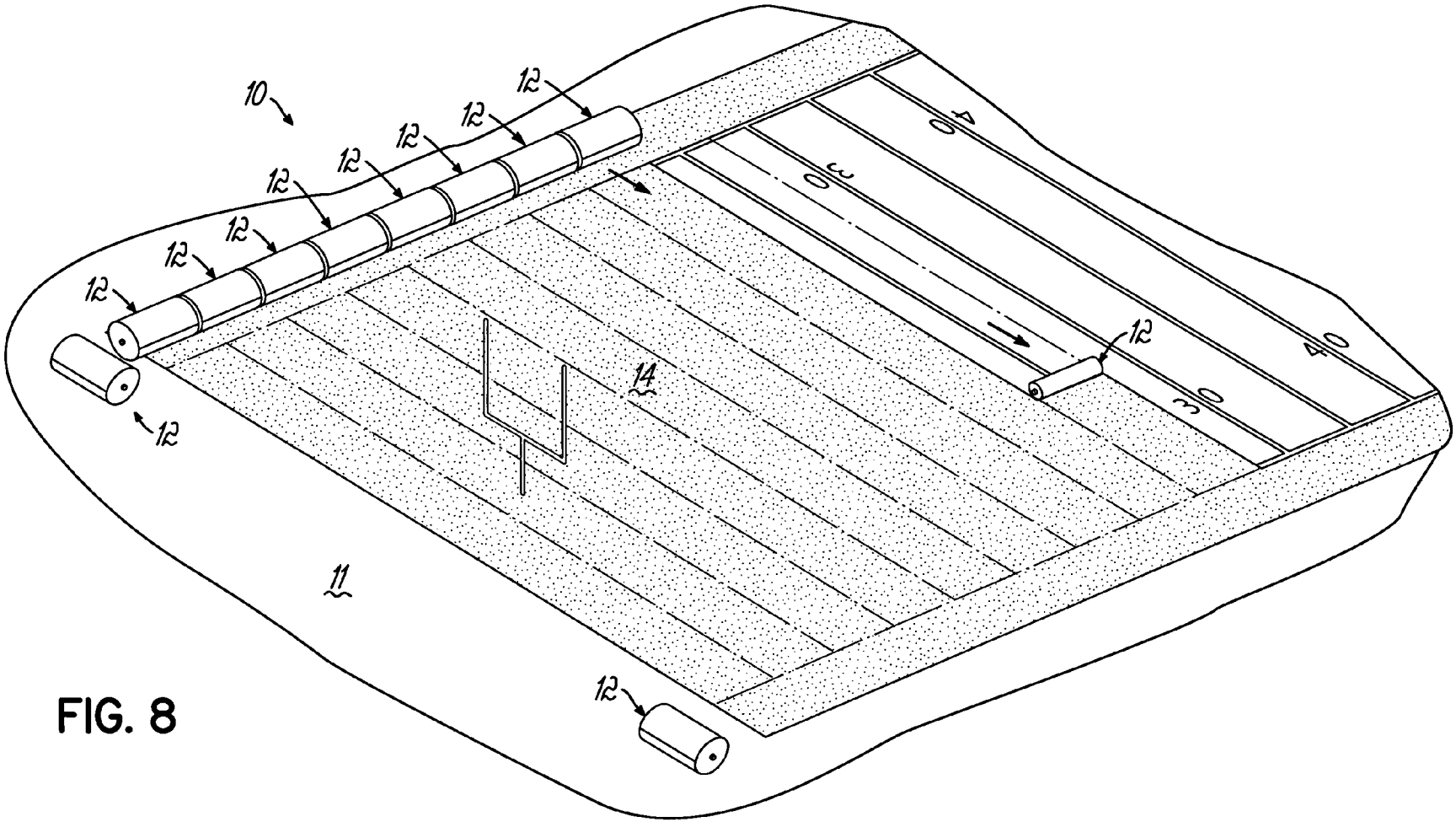
FIG. 8 is a perspective view which shows the installation of a field in accordance with the invention.

FIG. 8 illustrates a plurality of rolls 12 of filled artificial turf, each roll 12 comprising a section of filled artificial turf. Although the rolls 12 of filled artificial turf are illustrated being unrolled on a foundation 14 in a particular orientation, they may arranged and unrolled in any desired manner or configuration.

This detailed description describes one preferred embodiment of the invention. From this description, those skilled in the art will readily comprehend the general principals of the invention. Those skilled in the art will also understand the various modifications to which this invention is susceptible. For example, the backing may comprises multiple layers of material, the fibers may be of different lengths, the fibers may be fibulated and made of different materials such as any polyolyfin, the fill depth may vary and may comprise multiple materials including gravel or sand. Therefore, I desire to be limited only by the scope of the following claims and equivalents thereof.

I claim:

1. A method of creating an artificial turf comprising:

unrolling a plurality of already filled artificial turf sections on a foundation in a desired configuration to cover the foundation and define an athletic field, each of the sections including a backing, fibers secured to the backing and extending upwardly therefrom, and a particulate fill surrounding the fibers to a desired depth, the fibers having a construction and density so as to substantially contain the particulate fill to the backing during the unrolling;

removably connecting the sections along adjoining seams; and adding particulate fill along the removably connected seams, thereby to create a substantially uniform fill depth for the field.

2. The method of claim 1 wherein the removably connecting step further comprises:

locating a strip on the foundation along and under an adjoining seam of two adjacently located sections, the two adjacently located sections having adjacently located undersides, each of the undersides having a downwardly directed first component of a two component fastener, the strip having on an upper surface thereof, an upwardly directed second component of the two component fastener; and connecting the upwardly directed second component of the strip to the downwardly directed first components located on the undersides of the two adjacently located sections, thereby to removably connect the sections along the seam.

3. The method of claim 1 wherein the two component fastener is a hook and loop fastener.

4. The method of claim 1, further comprising:

removing particulate fill from the seams of adjacently located sections of filled artificial turf;

disconnecting the sections of filled artificial turf along the seams thereof; and rolling up the disconnected sections of filled artificial turf and moving them from the foundation.

5. The method of claim 2, further comprising:

removing particulate fill from the seams of adjacently located sections of filled artificial turf;

disconnecting the sections of filled artificial turf along the seams thereof; and rolling up the disconnected sections of filled artificial turf and moving them from the foundation.

6. The method of claim 5 wherein the disconnecting step further comprises:

separating the underlying strips from the adjacently located sections along the seams thereof.

7. The method of claim 1, further comprising:

locating a pad on the foundation prior to the unrolling step, the pad covering the foundation below the athletic field, thereby to enhance the overall resiliency of the artificial turf.

8. The method of claim 1, wherein the backing comprises three primaries, with the fibers tufted thereto and further secured thereto by a coated on secondary, whereby the backing has sufficient lateral structural integrity to withstand the rolling and unrolling of repeated installations.

* * * * *